United States Patent [19]

Harmon et al.

[11] Patent Number: 4,790,604

[45] Date of Patent: Dec. 13, 1988

[54] A CONTINUOUS PROCESS FOR MAKING A CONTINUOUS FABRIC

[75] Inventors: Albert D. Harmon, Clemson, S.C.; Ernest Koella, III, Rockford, Tenn.

[73] Assignee: Rockford Manufacturing Company, Rockford, Tenn.

[21] Appl. No.: 125,393

[22] Filed: Nov. 25, 1987

Related U.S. Application Data

[62] Division of Ser. No. 833,828, Feb. 26, 1986, Pat. No. 4,717,616.

[51] Int. Cl.[4] ..... A47L 13/20

[52] U.S. Cl. ..... 300/21

[58] Field of Search ... 15/147 R, 147 A, 229.1–229.9; 428/195, 294; 300/16, 21

[56] References Cited

U.S. PATENT DOCUMENTS

| | | | |
|---|---|---|---|
| 1,510,505 | 10/1924 | Severns | 300/21 |
| 2,300,821 | 11/1942 | Weaver et al. | 15/229.1 X |
| 3,115,658 | 12/1963 | Moss | 15/229.1 |
| 3,568,234 | 3/1971 | Komatsu | 300/21 X |
| 3,633,975 | 1/1972 | Argeris | 15/229.1 X |

FOREIGN PATENT DOCUMENTS

| | | | |
|---|---|---|---|
| 1434415 | 5/1976 | United Kingdom | 15/299.8 |

*Primary Examiner*—Mark Rosenbaum

*Attorney, Agent, or Firm*—Donald H. Feldman

[57] ABSTRACT

There is disclosed a mop head sheet-like fabric formed of a plurality of folded and twisted cords on each side of the midline of the fabric which are in side-by-side abutting relation to one another and have looped ends, the cords being bound together by a tape on each side of the midline adjacent to and inward of the looped ends, wherein the tapes have been perforated through with a patterning of needle holes; the fabric may be in a continuous form such as is sheeting and of a prescribed width, being that of approximately twice the length of the constituent cords. The fabric is easily handleable as is sheeting. Further disclosed is a continuous process for forming the present fabric, employing porcupine rollers to control the twisting of the cords and their side-by-side orientation, as well as their taping. Yet further disclosed is an apparatus for carrying out the process employing the aforesaid porcupine rollers.

5 Claims, 5 Drawing Sheets

A CONTINUOUS PROCESS FOR MAKING A CONTINUOUS FABRIC

CROSS-REFERENCES TO RELATED APPLICATIONS

This application is a division of application Ser. No. 833,828, filed on Feb. 26, 1986, and now issued as U.S. Pat. No. 4,717,616 on Jan. 5, 1988.

Another related application is Ser. No. 125,619 filed on Nov. 25, 1987, also a division of the same appln. Ser. No. 833,828, now U.S. Pat. No. 4,717,616.

Yet other related applications are Ser. Nos. 836,177; 836,176; 836,445; and 836,178, all filed on Feb. 26, 1986.

BACKGROUND OF THE INVENTION

1. Technical Field

The invention relates to a a new fabric structure of prolonged, indefinite length useful in making mop heads, with a continuous method for making such a fabric structure or article, and to an apparatus means for carrying out the continuous process.

More particularly, the invention relates to a mop head fabric material formed with looped edges or ends of the mop strings or cords thereof which tend to prevent or minimize the frittering away of yarn fibers during mop use or washing the mop head for reuse; further, this fabric is made in such a way and is of such a construction that the orientation of the constituent cords or strings is preserved in side-by-side adjacency throughout their lengths during processing and as desired during shipment until time of end use; still further the article of the invention is of such a construction that the twist imparted to the constituent yarns or rovings during formation is preserved until put into end use, and even during end use.

Also, the invention relates to a process for forming such a mop head fabric which is continuous in nature, and obviates the need for intervention by a human operator, such as in orientation or reorientation of the constituent yarns, rovings, cords or strings for further processing, to provide pronounced economies and reduced labor costs per unit mop head made from such a fabric so processed.

Yet further, the apparatus means of the invention relates to novel means for controlling the orientation of the constituent yarns, rovings, cords or strings during processing both relative one another and relative the constituent fibers thereof relative one another so as to maintain inserted twist within each strand element, and to maintain adjacency between succeeding strand elements throughout their respective lengths.

2. Background Information on Related Art and Problems

A mop head, by its nature, is a difficultly handleable and unruly article to make, to package, to unpackage, to ship and to market. One must arrange or orient the plurality of mop strings or cords substantially parallel one another before binding them either at one end of the assemblage or, if one uses strings or cords of double the length used in the mop product, at or along their midline with a binder which may be accepted by and fixed to mop handle. Such mop head products are readily seen in publications of the prior art, such as for example U.S. Pat. Nos. 1,625,857 (E. Jumonville); 2,035,130 (H. I. Klawans); 2,231,272 (H. I. Klawans); 2,238,432 (I. A. Myers); 2,300,821 (F. Weaver et al). Alternately, some constructions of mop heads use a binding for the constituent strings or cords at a plurality of locations between the midline and the cord ends or tips, such as are shown in other publications like, for example, U.S. Pat. Nos. 3,962,743 (Theron V. Moss); 4,085,476 (Theron V. Moss); and 4,364,476 (Theron V. Moss et al). Regardless of the particular construction, great care must be exercized in arranging the cords parallel one another and maintaining that orientation during processing the cords into a mop head. Usually, one is concerned with problems of disruption of the adjacent parallel arrangement of the cords, producing entanglements, snarlings, knottings and the like which must be disentangled, unsnarled and unknotted by hand or the product or its materials must be discarded as waste, a most costly venture whether by discarding or rearrangement into parallel orientation. This is especially vexsome when one considers that a mop head is formed of materials of usually very low unit value, and itself as a product is of relatively low unit value. Each hand operation or involvement therefore substantially increases production costs. In this regard, it is interesting to note that while the art is replete with suggestions for forming a clearly superior mop head by repeatedly folding back and forth textile strand material in the manner shown by Jumonville (U.S. Pat. No. 1,625,857), Klawans (U.S. Pat. Nos. 2,035,130 and 2,231,272) and others to form looped tips or ends to the mop head strands and strings, which permit the mop heads to be washed clean between usages without loosing fibers and frittering away and being destroyed in the process, as with free or cut-ended strings or mop cords, to the best knowledge of the present applicants little commercial usage has been made of such distinct advantage because of the extraordinarily high costs of labor inherent in their manufacture. Mop heads with looped cord ends, though expensive, are used in hospitals where one must either rewash between moppings or use new mop heads, but rarely in households where cut-end corded mop heads dominate the market and find favor because of cost. It is further interesting to note that looped-end mop heads are almost invariably made by sewing cloth or fabric tapes to hand-aligned, adjacent, parallel looped cords, such as shown and described in U.S. Pat. Nos. 2,035,130; 2,231,272; 2,300,821; 3,962,743; and 4,085,476.

From these observations, it is clear that the marketplace has long sought a shippable, sheet-like fabric, having a stable configuration of a plurality of substantially parallel strands of textile material extending outwardly in a prescribed width from a center line of any desired length, which later can be processed to form by cutting a superior, washable mop head of relatively low cost which is comparable to that of the cost of cut-ended corded mop heads.

DISCLOSURE OF THE INVENTION

1. Objects of the Invention

Accordingly it is an object of the invention to provide a mop head fabric construction which one may fashion into superior, washable mop heads which are of cost comparable to that of the cut-ended corded mop heads.

A further object of the invention is to provide such a mop head construction which assures mechanical handleability and obviates or at the least minimizes the need for manual handling in its manufacture and subsequent processing into mop heads, and their subsequent shipping and marketing.

A yet further object of the invention is to provide such a mop head fabric construction which obviates the need for operator intervention to adjust, align, orient or reorient the constituent cords or strings.

A still further object of the invention is to provide a continuous process for making such a mop head fabric construction.

Still further, another object of the invention is to provide an apparatus means for carrying out the aforesaid continuous process for making such a mop head fabric construction.

These and yet other desirable objects of the invention are attained through the practise of the invention now further described and defined by the explanations and claims which follow.

2. Summary of the Invention

A new and superior mop head fabric construction was discovered to comprise a plurality of substantially parallel, abutting strands of textile material, such as roving, or cords of twisted strands or yarns, having looped ends joining adjacent, abutting strands, said strands each being twisted inwardly from said looped ends toward its midpoint, and being fixed in such orientation of abuttable, substantially parallel adjacency and twisted individual cords or strings just inwardly of the looped joining ends thereof by a tape extending substantially normal to the axes of the cords and adhering to the contacting surfaces of the cords sufficiently strongly to maintain the cords in their orientation of parallel, abutting adjacency to one another of succeeding cords and to maintain the twist within each of the constituent cords. Optionally, it may prove desirable for certain specific embodiments, such as fabrics having unusually long strings or cords, also to adhere a tape between the two end tapes inward of the looped ends, such as along the midline of the cords, to improve handleability.

The present process for making such a superior fabric construction comprises: (1) a. Folding a strand of textile material, such as roving or yarn or twisted yarns, or the like, back and forth to provide a sequence of substantially parallel, which includes somewhat angularly disposed, strands of a prescribed length, such as from about twice to two and a half times the length of the cords or strings desired in the mop head end product, the parallel cords being joined at their length ends by loops created by the folding; b. Supporting the cords at their looped ends in a spaced apart adjacency for movement in a direction substantially normal to the axes of the cords; and c. so moving the array of cords; (2) a. Gripping the cords, as they are moved, along their midportion, such as along their midline; and b. twisting each strand, as it is so gripped and moved, inwardly from its looped end toward its gripped midportion or midline; (3) a. Releasing the midportion or midline gripping, as the array is further moved; and b. placing the sequential cords of the array into parallel, abutting alignment with each other as the array is yet further moved; (4) a. Gripping the cords, as they are moved, just inwardly of their looped ends; b. Removing support from the cords at their looped ends; and c. fixing the orientation of the constituent cords parallel and in abutment with adjacent ones, and the twist within each cord, such as by adhering a tape at or adjacent to the portion of the corded array where it is gripped concurrently with the gripping, the adhering being of sufficient strength to effect the aforesaid affixing; in some embodiments, the adhering may also be insufficiently strong to prevent delamination of the tapes as desired without destroying the fibrous structure of the constitutent cords and or their side by side orientation or twist; and (5) a. Ungripping or releasing the cords from the grip inward of the end loops; b. permitting the cords to contract toward the midline of the moving array; and c. optionally, fixing another tape at the midportion of the moving array of cords.

The apparatus of the invention comprises means for performing each of the aforesaid process steps interconnected in a manner effective to provide for the sequential and concurrent operations defined, wherein the means for supporting the looped ends for movement may be in the form of hooks which each may be rotated about an axis parallel to the axis of the corresponding cords, and the gripping means for gripping the cords may be in the form of a fixed or weighted pinned or needled or wire clothed cylinder or roller, the pointed projections thereof interpenetrating the fibrous body of the cords to grip the same.

THE DRAWINGS

A fuller understanding of the invention and its various aspects may be had by reference to the descriptions which follow when taken into conjunction with the appended drawings in which:

FIG. 1, in top plan view, shows the mop head fabric of the invention with its looped corded ends, its array of twisted, parallel and abutting adjacent cords or strings, and its end tapes;

Figure 6:
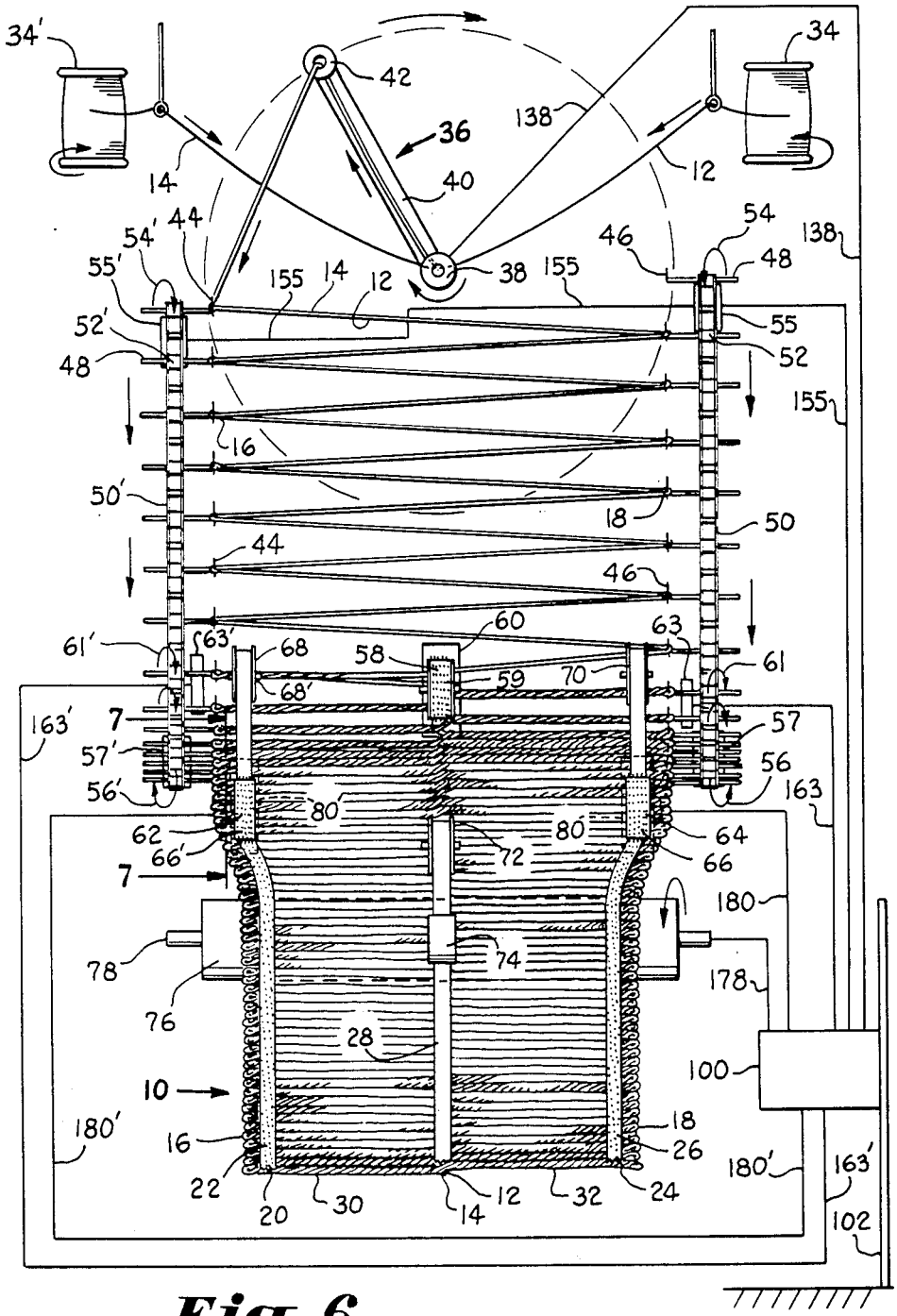
Figure 7:
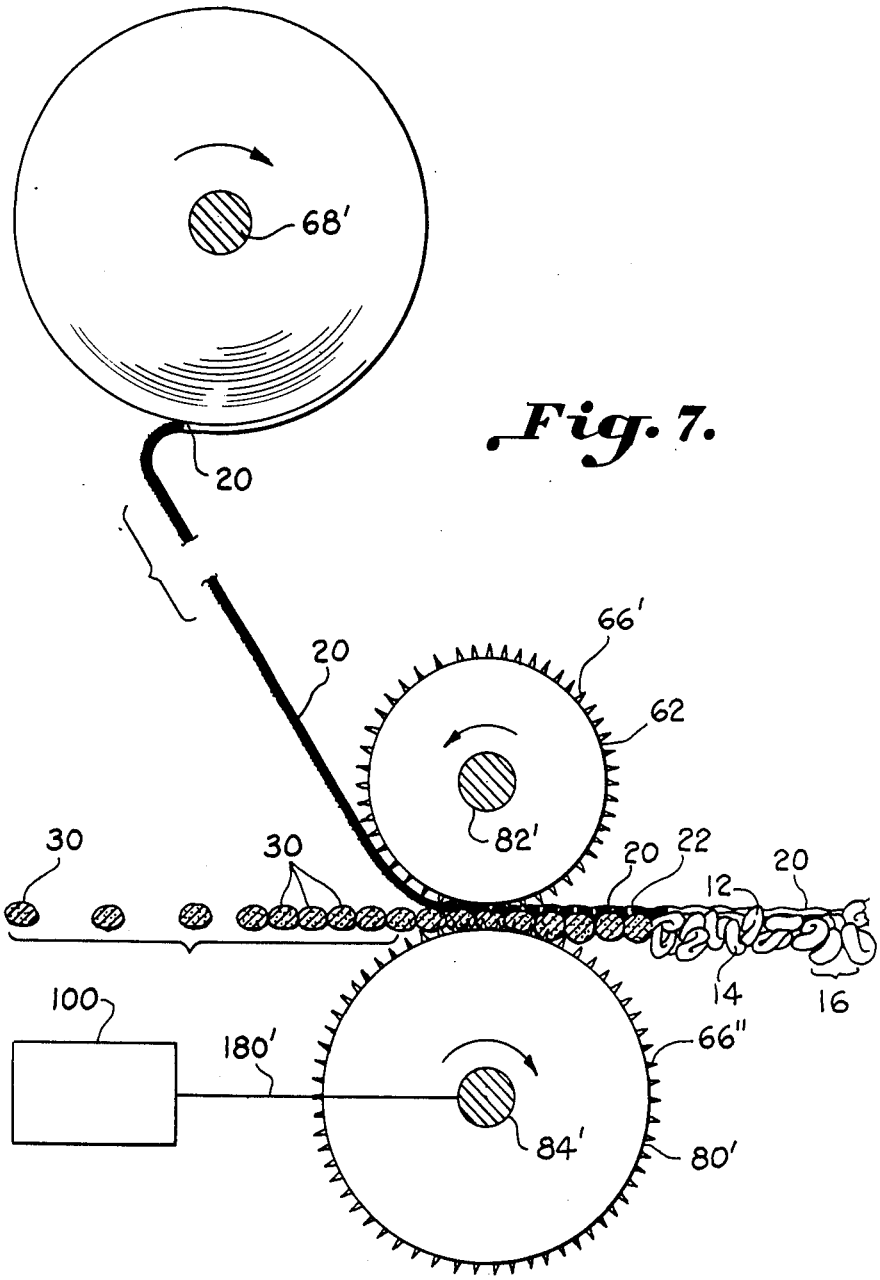

FIG. 6, in a somewhat diagrammatic top plan view, shows the apparatus of the invention in the process of forming the present mop head fabric; and FIG. 7 is a side-elevational section of the tape feed and gripping means shown in FIG. 6 processing cords to form the present fabric, and taken along line 7—7 thereof.

DESCRIPTION OF PREFERRED EMBODIMENTS

1. The Article of the Invention

With reference to FIGS. 1 to 4, the article of the invention, a fabric 10 of textile yarns or rovings 12 and 14, twisted to form cords 30, 32, folded at desired lengths between and to form looped ends 16 and 18, is shown to be held together by tapes 20 and 24, tape 20 positioned adjacent to and inward of looped ends 16, and tape 24 adjacent to and inward of looped ends 18. Preferrably, tapes 20 and 24 are perforated in a patterned manner with, respectively, perforations 22 and 26. Optionally, another tape 28 is fixed between tapes 20 and 24 at the midportion or along the centerline of fabric 10. Tape 28 is most advantageously employed when the length of cords 30, 32 is such that it is desirable to provide control of alignment of cords 30, 32 along the midportion for enhanced handleability. Although tapes 20, 24, 28 are shown fixed to but one surface of fabric 10, it is within the purview of this invention that, although not shown in the drawings, similar tapes 20, 24 and 28 may be positioned on both sides (top and bottom) of fabric 10 if for some particular embodiment such additional holding power provided by an additional adhering tape 20 and or tape 24 and or tape 28 should prove to be particularly desirable.

Particular advantage is found in using a tape material for tapes 20, 24 and 28 which has a rubber base type adhesive requiring a delaminating or separating force in the range between 15 to 45 ounces of force per inch width (167.42 to 3 times 167.42 grams force per centimeter of tape width); this is sometimes called the "peel strength." In one example, a tape material was used for tapes 20, 24 and 28 which had a polypropylene base or backing with a depth of 0.0034 inch (0.086 mm), a width of 0.375 inches (9.19 mm) and a rubber base adhesive having a peel strength of 28 ounces per inch of tape width (312.5 grams per centimeter of tape width) along the line of delamination or peel. In this example, as desired the tapes delaminated from the cords without disrupting either the orientation of the aligned cords or of the constituent fibers of the cords at the positions of adhesion and delamination. It is believed that the most preferred range of peel strengths for tapes 20, 24 and 28 where delamination may later prove to be desirable is from 20 to 30 ounces per inch along the line of delamination.

Figure 1:
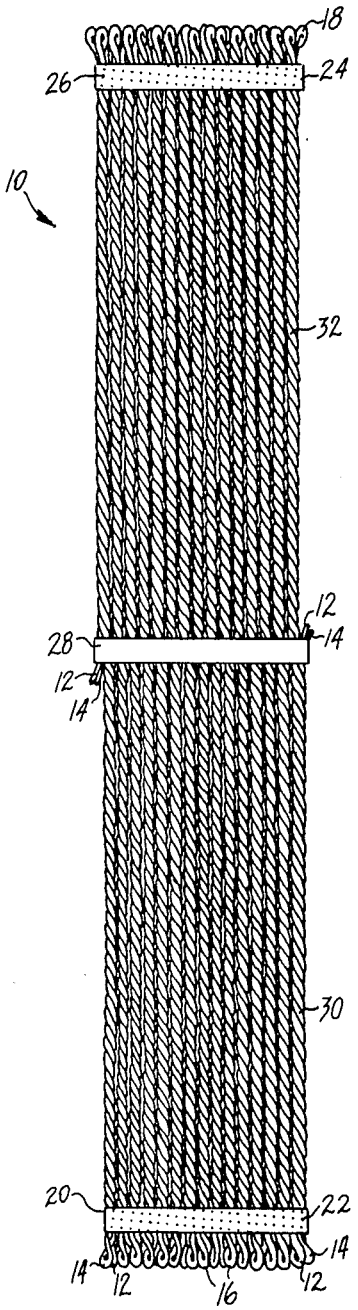
Figure 2:
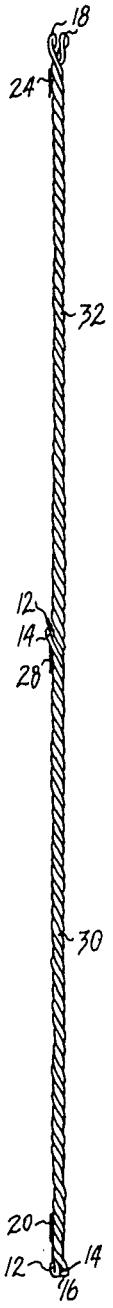
FIG. 2 is a side elevation of the article shown in FIG. 1, which latter has been rotated counterclockwise in this view.
Figure 3:
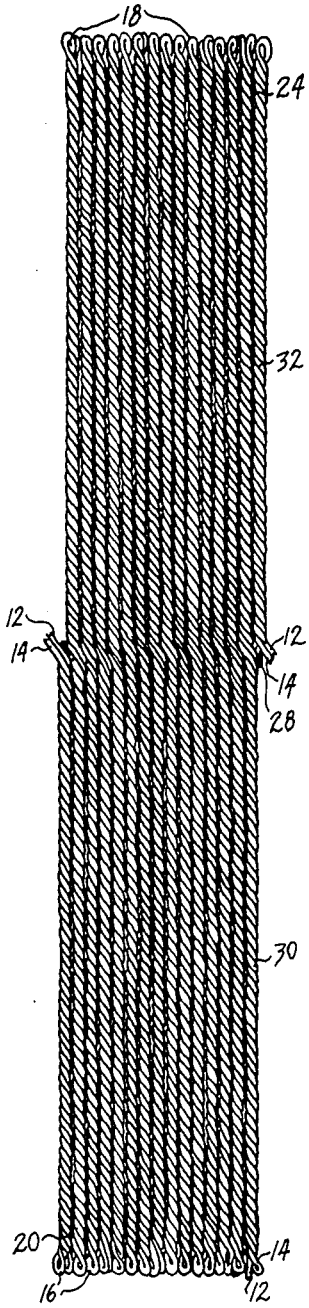
FIG. 3 is a bottom plan view of the article of FIG. 1, which latter has been rotated counterclockwise to provide this view.
Figure 4:
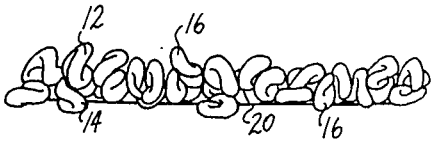
FIG. 4 shows a side elevation of the bottom end of the article of FIG. 1, showing the looped ends of the cords thereof and the tape fixed proximal those loops, in a view somewhat enlarged from those shown in the other drawings.

Although FIGS. 1 and 3 show only fifteen cords or strings 30, 32, this is just for purposes of illustration, for indeed the present fabric as here produced is in a sheet-like form of indefinite length, which is to say of any length which may prove desirable. For example, end product mop heads commonly are formed with 120 double length cords, joined in the middle to a mop handle or rod, producing 240 strings in all, 120 strings 30 and 120 strings 32. Thus, the fabric sheet of the invention conveniently could be cut into mop head size portions every 120 double length cords 30, 32 by counting by some known art means the 120 cords 30, 32 and then actuating some knife element to sever tape 20, tape 28 and yarns 12, 14 thereat, and tape 24.

In addition to being producible in continuous sheet like form of indefinite lengths, the present article has other desirable attributes. The otherwise unruly cords 30, 32 are in this invention joined securely to adjacent ones to form the present fabric article by means of tapes 22, 24 yielding the article in a sheet-like form which may be in length several hundred to several thousand yards or even more, and which sheet is now mechanically handleable preserving its hundreds of thousands to millions of cords 30, 32 in exact alignment and orientation. This is not possible with constructions of the prior art. The present article therefore may be handled, and packed and shipped if desired in any known manner used for ordinary sheeting of woven fabrics completely mechanically without the need of human, manual intervention or operations.

2. The Process and Apparatus of the Invention

Figure 5:
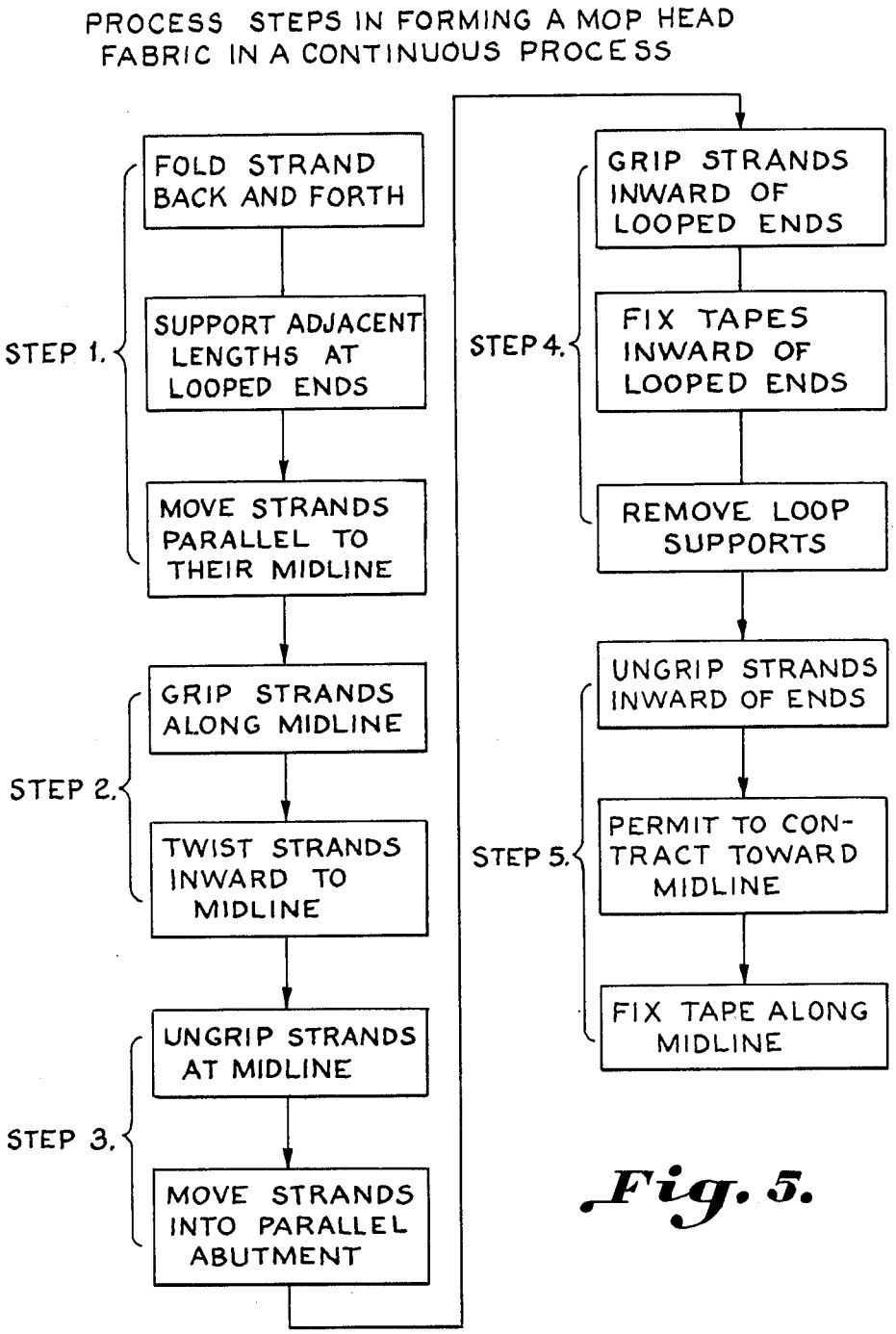
FIG. 5 is a flow sheet diagram of the steps of the present process.

The basic process steps of the invention to provide the present article are set forth in the flow sheet diagram of FIG. 5, while the basic elements of the present apparatus employed to carry out the process are shown in FIGS. 6 and 7, to which the attention of the reader is now drawn.

Step 1 - Fold Strand Back and Forth

The cords 30, 32 of the present article are formed from a roving or yarn or other elongate strand of textile material 12 and or 14. It is possible to form cords 30, 32 from a single strand, however, as shown in FIGS. 1 to 4 and 6, a plurality of strands is preferred, two of which 12 and 14 are used in the embodiment shown. The elongate strands 12, 14 may be formed, and preferably are formed, of staple rather than continuous filaments, although the latter may be used under circumstances indicating its desirability in the end use mop head product. At any event, whether one or a plurality of strands 12, 14 is used, or whether they are formed from staple or continuous filament or both, the present process steps and apparatus for carrying them out are substantially the same as shall now be further described. This is also so if one were to use as the elongate strand a cabled strand of various yarns or even a net wrapped strand such as is described in U.S. Pat. No. 2,300,821.

With particular reference to FIG. 6, yarns 12, 14 fed from some supply means such as bobbins 34 are folded back and forth to provide somewhat parallel lengths thereof, in the following manner. Yarns 12, 14 are passed through a folding means 36 therefor, means 36 receiving and moving them laterally in one direction a prescribed distance, folding them over and then moving them laterally in the opposite direction, repeatedly. One such means 36 is in the form of a rotating flyer or swing arm 40, mounted for rotation about its central bearing 38 which bearing 38 receives yarns 12, 14 from bobbins 34. Yarns 12, 14 then pass along the length of arm 40 and through and out from its terminal bearing 42. As arm 40 rotates about bearing 38, its terminal bearing 42 describes a circular pathway, shown in FIG. 6 as clockwise by the arrow thereabove; the movement of yarns 12, 14 follows the pathway indicated by the arrows adjacent to them.

In this embodiment, arm 40 is selected to be of such length so as to exceed the sum of the lengths of cord 30 and cord 32 by a prescribed amount. This will be further described in the explanation of what we call Step 5, below.

The folding of yarns 12, 14 provides them with what we call looped ends 16, 18. In order to support folded yarns 12, 14 for movement in a direction normal, or substantially so, to their direction of axial orientation produced by the folding, a plurality of yarn-receiving hook elements 44 (to the left as seen in FIG. 6) and 46 are provided. Hooks 44, 46 are mounted in bearings-like chain link members 52' and 52 respectively at the inwardly directed ends of spindles 48 received in bearings 52 of a pair of spaced apart endless chains 50. In this embodiment, chains 50', 50 are shown vertically disposed in the form of two loops, the upper flights of which are substantially horizontal and parallel one another. Chains 50', 50 are shown to straddle the circular pathway defined by rotation of arm 40 and its terminal bearing 42 in such a manner that as the chains 50', 50 are moved in the directions as shown by adjacent arrows, the hooks 44, 46 extend inwardly to a degree sufficient to intercept the pathway of bearing 42 and yarns 12, 14 issuing therefrom to receive by hooking yarns 12, 14 as hooks 44, 46 ascend the near end of the loops of chains 50', 50 to begin movement along the upper flight of their loops. This may be done by mounting chains 50', 50 onto pulley wheels (not shown) vertically disposed at such near end for guiding and or driving chains 50', 50 to effect their ascent to the upper course to be followed by the upper flight of the chains 50', 50. This ascent is indicated adjacent each near end or loop of chains 50', 50 by curved arrows 54. Thereafter, chains 50', 50 are moved along the upper flight courseway in the direction of the arrows adjacent thereto; at a predetermined point, each chain 50', 50 is moved to descend to its lower flight (not seen), which, again, may be done by being guided by pulley wheels 57', 57 at such predetermined point, as shown by the arrows 56.

Step 2 - Gripping and Twisting Strands

In the article of this invention, cords or strings 30, 32 are cabled or twisted; thus, it also is necessary to twist yarns 12, 14 about their axes to provide cords 30, 32. Further, in the present article, the twist is inward from each looped end 16, 18 toward the midportion or midline where cord 30 and cord 32 meet as yarns 12, 14. In order that the twistings from the looped ends 16, 18 be stable, the twistings would have to result in both cabled cords 30, 32 having the same twist sense, either Z or S type, not both; for present purposes, an S type twist for both cords 30, 32 is preferred. Also, it is necessary to stop the inward twistings from the opposite looped ends 16, 18 at the midportion or along the midline of folded yarns 12, 14.

Again referring to FIG. 6, mounted intermediate the extent of the upper flights of chains 50', 50 and along the midline between the chains 50 is a porcupine roller 58 so that it will intercept folded yarns 12, 14 along their midline or midportion as they are moved substantially normal to their axes by moving hooks 44, 46 borne by moving chains 50', 50. Roller 58 bears an outer cylindrical surface outsprouted with a plurality of needle-like elements 59, which may be in the form of card clothing or pins or needles to engage the middle portion of folded yarns 12, 14 as they are moved under roller 58 by interpenetrating them. Roller 58 is used with a cooperating element 60 to assure positive engagement of yarns 12, 14 by elements 59. Element 60 may, for example, be in the form of a guide plate set at a spacing from the closest approach of the points of elements 59 which is less than the cross-sectional width of the two strands 12, 14; alternately, element 60 may be in the form of another porcupine roller the tips of the points of which would be spaced from those of roller 58 so as to assure positive engagement of yarns 12, 14 by the points; yet alternately, element 60 may be in the form of another guide plate formed with a central orifice which plate is spaced from roller 58 such that elements 59 may interpenetrate the central orifice causing the points thereof to interpentrate the central portion of yarns 12, 14 as they are moved over the top surface of guide plate 60. Roller 58 is of sufficient size so that its porcupine surface will at any one instant engage at least one, and more desirably a plurality of center portions of yarns 12, 14 passing thereunder.

To each inward side of chains 50', 50 laterally adjacent to where roller 58 engages moving yarns 12, 14, twisting means are provided; in FIG. 6, such twisting means is in the form of rollers 63' and 63, each of which is positioned respectively between its adjacent chain 50', 50 and roller 58 seen to be inboard of each of chains 50' and 50 and positioned so as to intercept spindles 48 to contact their undersurfaces as spindles 48 are moved thereover. Usually during movement of chains 50', 50 in a direction substantially normal to that of the axes of folded strands 12, 14, hooks 44, 46 and their spindles 48 are held in one position, which we shall call upright, relative to moving chains 50', 50', due to the tension exerted on hooks 44, 46 by the folded over taut strands 12, 14 at their looped ends 16, 18. In order to twist yarns 12, 14 inwardly from each of looped ends 16, 18 to form cables or strings 30 and 32, spindles 48 in turn have to be rotated relative their bearings 52', 52 of chains 50', 50. For this, spindle-contacting twisting means 63', is driven to rotate in a direction which is opposite in sense to that of the arrows 61' and 61 shown adjacent to spindles 48, thus in turn to force spindles 48 to rotate in the same directional sense as arrows 61' and 61, also in turn then rotating hooks 44 to form twisted cables or strings 30 on the lefthand side of FIG. 6, and its rotating hooks 46 to form twisted cables or strings 32 to the right. It is to be noted that in the formed article 10 cables 30 and 32 appear to be and in fact must be twisted in the same twist sense, which is to say either S or Z twist, but not both. In the present preferred embodiment, as seen best in FIGS. 1 to 3 and 6, one notes that cables 30 and 32 are of S twist. Now since the twists are inserted inwardly from the looped ends 16, 18, in order to provide the same twist sense to both cables 30, 32 one must rotate hooks 44 in a rotational sense opposite to that for rotating hooks 46; this clearly is seen in FIG. 6 in that arrows 61' designating rotation of hooks 44 are in the opposite directional sense of arrows 61 which on the righthand side designate the rotational sense of hooks 46.

Thus, as yarns 12, 14 folded and looped over moving hooks 44, 46 on respective moving chains 50', 50 are moved in the direction substantially normal to their axes their midline portions are received between elements 58 and 60, the pointed projections 59 of roller 58 interpenetrate yarns 12, 14 and in effect engage them in a rolling snubbing action; concurrently, spindles 48 bearing hooks 44, 46 of those yarns 12, 14, which are then engaged in the rolling snubbing action of projections 59, are drivingly rotated in the directions 61', 61 to twist each half portion of yarns 12, 14 extending between the respective hooks and the points of snubbing action inwardly to provide the respective cables 30, 32. The rate of driving rotation of twisting rollers 63', 63 is such so as to provide a minimum of one twist for every two inches (5.08 centimeters) of length of cables 30, 32, with a preferred range of one to one and a half twists per inch per 2.54 centimeters of cable length, as yarns 12, 14 are continuously moved along by moving chains 50', 50.

Step 3 - Unsnubbing and Abutting Adjacent Cables

Further movement of cabled yarns 12, 14 moves them out from under the snubbing action of teeth 59 of snubbing roller 58, and thereupon the inserted twist from each of cables 30 and 32 moves inwardly to meet at the midline portion thereof.

Adjacent, somewhat parallel folded yarns 12, 14 pairs are required to be spaced from one another until this point, because of the need for enough room to rotate adjacent hooks 44 and 46 and to keep adjacent twisting cables 30 and 32 from interfering with adjacent like cables during the twisting operation. The sheet-like article product, however, requires that adjacent cables 30 and 32 be in abutting adjacency. Although this step of moving adjacent cords into abutting adjacency with one another may be thought of and defined as a discrete process step, we have found that it may be most felicitously carried out mechanically in direct and dependent conjunction with the next step, which includes the operations of gripping the cabled strands 30, 32 just inwardly of the hooked looped ends 16, 18, applying end binding tapes to cabled strands 30, 32 and unhooking looped ends 16, 18. As indicated in the flow chart of FIG. 5, moving cabled strands 30, 32 into parallel abutting adjacency must precede their gripping, taping and unhooking.

Referring now to FIGS. 6 and 7, following cabling, the upper flights of moving chains 50, 50′ are shown to turn downwardly following the directions indicated by adjacent arrows 56, 56′ over respective pulley wheels 57, 57′; as they so move, the spaced out separation between adjacent spindles 48 is reduced to bring adjacent cables 30 and 32 into abutting adjacency with one another.

Step 4 - Gripping Cabled Strands, Removing Hooks, Fixing Tapes

Although chains 50, 50′ are moved downward over pulley wheels 57, 57′, the matrix of adjacent and abutting cables 30 and 32 continues to follow a pathway which is substantially horizontal.

Along such pathway, just as chains 50, 50′ begin their descent over pulleys 57, 57′ cabled strings 30, 32 are seized by pointed teeth projections 66, 66′, 66″ of porcupine rollers 62, 64, 80, 80′ set in pairs 62, 80′ and 64, 80. These provide a bight at the nips therebetween to receive the matrix of cabled cords 30 and 32, keep the matrix on a substantially horizontal pathway, thus to permit the withdrawal of hooks 44, 46 from the respective end loops 16, 18 as chains 50′, 50 move out of the horizontal and into their descent to the lower flight of their moving looped pathways, and to prevent the premature contraction of cabled cords 30, 32 toward their midline due to the removal of the restraining force of hooks 44, 46.

Thus one sees that by locating the end of the upper horizontal flight of chains 50, 50′ and the paired porcupine rolls 62, 80′ and 64, 80 in corrresponding adjacency such that the matrix of cabled cords 30, 32 may be seized just prior to full release of cords 30, 32 by hooks 44, 46 one now conveniently avoids the previously unavoidable disruption of cord orientation normally due to the sudden or abrupt relief of the tensions created during the cord twisting step, with the concomitant chaotic and sudden snapping inwardly, each cord 30 and 32 being out of any control. By this means one then may achieve the object of permitting relief of these tensions under controlled conditions, as shall further be described in discussing Step 5 hereunder.

To maintain control over cords 30, 32, to preserve their orientation relative one another, and thus to provide a handleable article, four functions are performed concurrently: (a) the matrix of horizontally moving cables 30, 32 is seized as above described; (b) the end loops 16, 18 are disengaged from chain hooks 44, 46, also as above described; (c) the matrix orientation is fixed as to any cable relative the others, as shall be further explained; and (d) the matrix now with such fixed orientation is moved further along its horizontal pathway by the driving action of the paired porcupine rolls.

The preferred embodiment, shown in FIGS. 6 and 7, shows greatest economies in apparatus construction by employing the paired porcupine rolls 62, 80′ and 64, 80 not only to seize the cord matrix and urge it forward along its horizontal pathway, but also to be used as pressure rolls to fix the presently required adhesive tapes to the cabled matrix thus thereby to fix the orientation of any cable relative the others in the sheet-like article of this invention.

As shown, each pair of porcupine rolls 62, 80′ and 64, 80 are mounted so that they are laterally between end loops 16 and the center line and between end loops 18 and the centerline, just adjacent to the end loops and spaced from hooks 44 and 46 as they pass by. In line with each paired roll set 62, 80′ and 64, 80 is mounted a roll 68 and 70 of adhesive tape 20, 24 or the type previously described such that as tape is pulled from the roll its adhesive or sticky side surface faces the opposing surface of the matrix or array of cabled strings 30 and 32, as best seen in FIG. 7. In this preferred embodiment, tape 20 is inserted atop cables 30 as the latter enter the bight of the nip between porcupine rolls 62 and 80′ and are seized by the needled projections or teeth 66′ and 66″. Roll 62 may be fixed relative fixed roll 80′ such that the distance between their outer surfaces assures the application of sufficient pressure by their teeth 66′ and 66″ to interpenetrate the array of cables 30 passing between them, to prevent the cables 30 from shifting laterally toward their center or from changing their side-by-side orientation abutment with one another. Alternately, either roll 62 or roll 80′ may be on a swing arm with the other roll fixed, the swing arm roll being biased toward the fixed roll by dead weight, or springs or other known biasing means to provide sufficient force to cause the aforesaid seizing of the array of cables 30, and piercing through of tape 20 with holes 22. Although we have here described the requirements relative the components to the left hand side of FIG. 6 as also shown in FIG. 7, it is to be understood that such descriptions also apply to the components to the right-hand side of cabled array 10.

In a less preferred alternate arrangement, where for some reason it proves desirable to provide tapes 20, 24 without holes in the sheet-like article of the invention, this can be done by mounting tape rolls 68, 70 inboard of porcupine roll pairs 62, 80′ and 64, 80, which is to say somewhat closer to the midline than the positions shown in FIG. 6. Also, a pair of pressure tape applicator rollers would be positioned adjacent to and inboard of porcupine roll pair 62, 80′ and another adjacent and inboard of roll pair 64, 80. Tapes 20, 24 then are inserted into the bight of the respective pressure applicator rollers, and as the porcupine roll pairs grip the cables 30, 32 as the latter are moved, so too cables 30 are fixed relative one another by tape 20 and cables 32 by tape 24, the tapes then being unperforated. One skilled in the are may think of many variations of the present teachings, for example using roll pairs which have porcupine projections along part of their surfaces such as the outer half and the inner portion or other part being smooth, with the tapes being run between the smooth surfaces.

However, it has been found that there appears to be a valuable coaction between applying the tapes under pressure to the top peripheral surfaces of aligned cables 30 and aligned cables 32, and also piercing through the tapes with the needle projections, that coaction appearing to enhance the adhesion of the tapes to the peripheral cable surfaces, and thus providing a desirable extra degree of assurance of the tapes not delaminating inadvertently during succeeding processing, handling, shipping and the like.

Once so taped, the sheet-like article of the invention is formed.

Step 5 - Ungripping, Relaxation and Midline Taping of Cables

As the driven porcupine roll pairs 62, 80′ and 64, 80 seize cables 30 and cables 32, and pressure and puncture join tapes 20, 24 to the upper surface of the arrayed cables, looped ends 16, 18 are disengaged from hooks 44, 46, and thereupon it is only the interpenetrating teeth 66, 66', 66'' and pressure exerted by the paired rolls 62, 80' and 64, 80, and the adhering tapes 20, 24 which provide for control over the cables to maintain them in substantially parallel abutting side-by-side relation. The taped cables are forced by porcupine roll pairs 62, 80' and 64, 80 to continue to move along the aforesaid substantially horizontal pathway of matrix 10, and out of the nip of the constituent needled projections 66, 66', 66''. Immediately upon being freed, taped cables 30, 32 tend to contract in an action which largely relieves the stresses imposed upon twisting yarns 12, 14 into cables, and thus causes the cables' looped ends 14, 16 to move toward the midline of article 10 to shorten them. One skilled in the art, with a knowledge of the number of turns per inch of length of cables 30, 32 to be provided and the desired length of cables 30, 32 after the tension is relieved and they are shortened, can calculate the desired distance of separation of hooks 44 from hooks 46 which will bear the untwisted strands of folded over yarns 12, 14. This then will determine the diameter of the circular path to be generated by terminal bearing 42 and the length of arm 40 to be used.

The shortening of cables 30, 32 is shown clearly in FIGS. 6 and 7. It is this immediate and almost explosive contraction which in the past has defied attempts to provide maintenance of a stable configuration of adjacent abutting cables, but is now solved and used in the present invention to provide the almost endless article sheet-like matrix of the invention wherein absolute control and maintenance of cable orientation is obtained. The present taped structure is the answer long sought for in the art.

When cords 30, 32 are of such a length as to make it desirable to provide additional control of the middle portions of article 10, one may apply a tape along the midline such as a tape 28 affixed to the top midline surface of article 10 by pressure application by a pressure roll 74 cooperating with an undergirding doffer roller 76, tape 28 being pulled from a supply 72 thereof.

Other aspects of the present apparatus are shown diagrammatically. For example, all elements of the apparatus are supported by a frame, denoted at 102, including a source of power and control means for energizing and controlling all mechanical movements and the interactions of all apparatus elements so that they will move and otherwise function as previously described, all of which necessary components, such as motors, controllers, electrical, pneumatic or hydraulic switches, valves and circuits are symbolically represented by the black box marked 100. Those apparatus elements and means which are driven from power and control means 100 are shown as supported by and energized and controlled through interconnections joining such elements and means with power and control means 100 and frame 102, as seen in FIG. 6.

More particularly, swing arm 40 and its bearings 38, 42 are energized and controlled for rotation and rate of rotation by power and control means 100, and are interconnected by connecting means 138, shown symbolically as a lead line connecting box 100 with bearing 38, which means 138 is to be understood to comprise whatever is needed to transmit power and control signals and physical support to permit folding means 36 to perform its proper function at its proper rate to effect the folding of yarns 12, 14 in cooperation with moving chains 50', 50 and their hooks 44, 46. In this regard, one notes that pulley wheels 55', 55 which drive chains 50', 50 in the direction of their adjacent arrows receive their power and control signals and physical support by connecting means 155 joining them to means 100 and means 102. Means 100 coordinates the rates of rotation of folding means 36 via connecting means 138 and rates of movement of chains 50', 50 and thus of their respective hooks 44, 46 via pulleys 55', 55 and connecting means 155 such that as bearing 42 moves it will be brought into the necessary adjacency to a hook 44 when hook 44 intercepts the circular pathway of bearing 42 to the hook-issuing yarns 12, 14 thereat; and, in similar manner, bearing 42 will be brought into similar adjacency to each hook 46 as it, in turn, intercepts the pathway of bearing 42, and hook-issuing yarns 12, 14 thereat, to cause the folding over of such yarns alternately forming the looped ends thereof in accordance with the process step fo the invention.

Further, means 100 also coordinates and controls the rate of movement of chains 50', 50 as previously described, and also the rate of rotation of twisting means 63, 63' respectively through connecting means 163', 163, such that as chains 50', 50 and supported and folded yarns 12, 14 are moved, twisting means 63', 63 and its spindles 48 in turn rotate hooks 44, 46 a prescribed number of turns to impart a precribed twist to cable cords 30, 32 in the same twist sense.

Yet further, means 100 coordinates and controls the rates of rotation of porcupine rollers 62, 64 through their underlying rollers 80', 80 so as to seize cords 30, 32 and move the same forward in the same pathway as the cords 30, 32 followed upon entering the nips between roller pairs 62, 80' and 64, 80, by means of respective connecting means 180', 180. In this manner, the rates of movements of hooks 44, 46 also are controlled so as to cause cords 30, 32 to be seized and taped prior to being freed completely from hooks 44, 46 as the latter make their downward turning about pulley wheels 57', 57, and to permit thereafter taped fabric 10 to continue in its same direction and to shrink toward the midline to relieve the excess stress imparted during the twisting step.

Still further, means 100 coordinates and controls the rate of rotation of doffer roll 78 so that it may perform two functions, that of continuing to move taped fabric 10 away from the apparatus, and also to permit the optional taping of fabric 10 along its midline with tape 28 by cooperation with the driven pressure applying roll 74.

One skilled in the art will readily recognize that one may use variations from the structure here described, their interconnections and cooperations within the scope of the claims below to provide the present taped mop head fabric by a suitable process as claimed and an apparatus as claimed to pursue such a process, such variations being changes merely in contours, and components well within the knowledge of any craftsman, to provide equivalents to what here is defined.

We claim:

1. A continuous process for making a continuous mop head fabric comprising the steps:

a. continuously feeding a strand of textile material from a supply thereof;

b. repeatedly folding said strand back and forth so as to provide a discrete and predetermined length of said strand between sequential foldings and at each folding to provide a looped end between consecutive discrete lengths of said strand;

c. supporting said consecutive discrete lengths of said strand at their consecutive looped ends for moving said folded and supported lengths of said strand in a direction substantially parallel to a line joining the midpoints of said consecutive lengths of said strand and so moving said strand lengths;

d. gripping said consecutive strand lengths along said midline thereof, and twisting from each looped end of said strand lengths inwardly toward said midline a prescribed number of turns to provide a twisted or cabled cord;

e. consecutively releasing said strand lengths along their midline, and continuing to move them in said direction while bringing said cords thereof into side-by-side, parallel abutting relationship on each side of said midline;

f. gripping said twisted cords inwardly of their looped ends and adhesively fixing a tape proximal the location of said gripping to a surface of said cords to fix said cords in their abutting relationship with one another; and g. releasing said support at said looped ends, and releasing said gripping inwardly of said looped ends.

2. A process according to claim 1, wherein, following said releasing of said support and said gripping, adhesively taping said midline of said strand material is pursued to bind into adjacency consecutive portions of said material along said midline.

3. A process according to claim 1, wherein said grippings are effected by means of porcupine rollers.

4. A process according to claim 1, wherein said gripping of said twisted cords and said fixing of said tape proximal said location of said gripping are done concurrently and at the same location on a surface of said cords.

5. A process according to claim 4, wherein said gripping and fixing are performed by a pressure biased porcupine roller, the projections of which perforate said tape in so fixing.

* * * * *